United States Patent [19]

Parenteau

[11] Patent Number: 4,669,675

[45] Date of Patent: Jun. 2, 1987

[54] WINDING MACHINE ARBOR WITH STRAIN RELIEF PROTECTION

[75] Inventor: James E. Parenteau, Hugo, Minn.

[73] Assignee: Honeywell Inc., Minneapolis, Minn.

[21] Appl. No.: 821,622

[22] Filed: Jan. 23, 1986

[51] Int. Cl.[4] ..... H01F 41/06

[52] U.S. Cl. ..... 242/7.09; 242/7.17

[58] Field of Search ..... 242/7.06, 7.09, 7.17, 242/118.4; 140/92.2

[56] References Cited

U.S. PATENT DOCUMENTS

| | | | |
|---|---|---|---|
| 3,085,765 | 4/1963 | Ulrich | 242/84.1 |
| 3,314,452 | 4/1967 | Cartwright et al. | 140/92.2 |
| 3,332,633 | 7/1967 | Carson | 242/7.09 |
| 3,465,982 | 9/1969 | Coshow | 242/84.2 |
| 3,643,326 | 2/1972 | Boke et al. | 29/605 |
| 3,666,197 | 5/1972 | Coshow | 242/84.1 R |
| 4,610,278 | 9/1986 | Damon et al. | 242/7.09 |

FOREIGN PATENT DOCUMENTS

| | | | |
|---|---|---|---|
| 2043165 | 3/1972 | Fed. Rep. of Germany | 242/7.09 |

*Primary Examiner*—Billy S. Taylor

*Attorney, Agent, or Firm*—Alfred N. Feldman

[57] ABSTRACT

An arbor for winding an electrical coil on a winding form or bobbin utilizes a centrifugally actuated pin. The pin is initially in place so that the first lead-in wire is formed with a strain relief loop. As the arbor is rotated for winding of a coil, the pin is centrifugally removed thereby eliminating any stress that would break a fine wire during winding.

6 Claims, 5 Drawing Figures

WINDING MACHINE ARBOR WITH STRAIN RELIEF PROTECTION

BACKGROUND OF THE INVENTION

Coil winding machines have been in use for many years, and are now fully automated. This automation became practical when molded winding forms having a lead-in slot were developed. The lead-in slot provides a means for protecting the lead-in wire of the electrical coil when the coil is wound automatically. This type of winding slot, in its earliest version, is found in the Brekke et al U.S. Pat. No. 3,131,371. The exact form of the lead-in slot has been extensively modified by changing its contour and slope. Lead-in slots are now used routinely in automatically wound coils for all types of electrical devices.

The typical winding machine mounts a winding form or molded bobbin against an arbor. The winding form or bobbin is then held in place while an initial turn of wire is wrapped around an electrical terminal that is molded or inserted into a flange of the bobbin. The bobbin or winding form is then rotated with the arbor. The wire that was wrapped around the terminal is automatically directed into the lead-in slot and is brought out on the core of the bobbin. The arbor is then rotated rapidly to wind the desired number of turns of wire on the winding form. The wire is automatically led out to a further terminal structure and wrapped During the manufacture of the coil, it has been found that a strain relief loop in the wire is necessary between the first terminal and the lead-in into the protective slot of the bobbin or winding form. This typically has been accomplished by mounting a pin on the arbor. The pin causes the wire of the coil to be led over the pin prior to its entry in the lead-in slot. This strain relief loop later prevents breakage between the terminal and the lead-in conductor when the coil or electrical device is further handled and processed.

In the winding of electrical coils that use relatively heavy wire, the strain relief pin causes no particular problem. Where the wire being wound is of a small cross section, the pin that is intended to provide the strain relief loop has a tendency to apply a sufficient force against the strain relief loop to cause breakage of the lead-in wire. This in turn causes a relatively high rejection rate of electrical coils wound with small wire in this type of winding environment.

SUMMARY OF THE INVENTION

The present invention is directed to a strain relief pin similar to the pins used on conventional arbors in winding machines, but the pin is supported in a moveable manner. More specifically, the pin is supported by a centrifugally operated mechanism that withdraws the pin from contact with the wire when the winding arbor and its associated winding form or bobbin is rapidly rotated during the winding process. The centrifugal movement of the pin out of contact with the strain relief portion of the winding has been found to substantially eliminate breakage of the lead-in wire at the strain relief loop when electrical coils are wound by automatic winders on molded winding forms such as have been described in the Background of the Invention.

In accordance with the present invention, there is an arbor means for use with an automatic coil winding machine, including: arbor means adapted to receive and hold on a front arbor surface an insulated winding form upon which a coil of insulated wire is to be wound; said winding form having at least one electrical terminal upon which said wire is initially secured by said winding machine; retractable pin and support means mounted upon said arbor means and including a retractable pin positioned adjacent a side of said terminal; said pin and support means including centrifugally actuated means mounted on said arbor means; said retractable pin and support means further including bias means to hold said retractable pin adjacent said side of said terminal with said pin acting to form a strain relief in a portion of said wire when the winding of said coil is initiated; and said arbor means rotating with said winding form to wind said coil of wire; said rotation activating said centrifugally actuated means to withdraw said pin from said side of said terminal and out of contact with said strain relief portion of said wire to avoid subsequent breakage of said wire.

DESCRIPTION OF THE PREFERRED EMBODIMENTS

Figure 1:
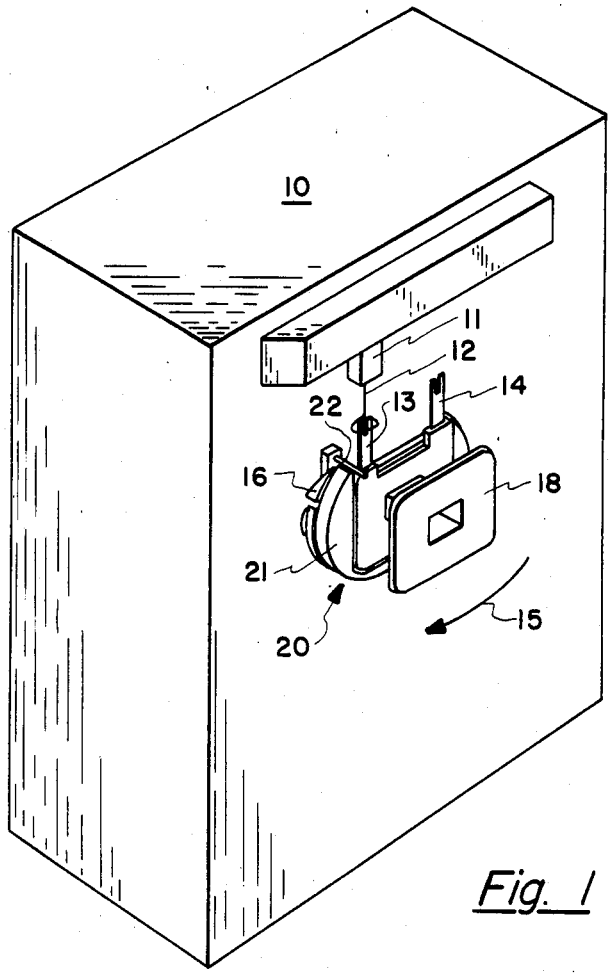
FIG. 1 is a representation of a winding machine.

In FIG. 1 a winding machine 10 is represented. The winding machine 10 is of an existing design and will only be explained to the extent necessary to explain the novel arbor means generally disclosed at 20. The winding machine 10 includes all of the necessary equipment for automatically placing an electrical wire, winding it on a winding form, and terminating the wire at a second terminal. The means for placing a winding form or bobbin 18 is not disclosed, and could be accomplished manually. The winding machine 10 has an arm 11 which places an electrical conductor or insulated wire 12 around a first terminal 13 of the bobbin or winding form 18. The bobbin or winding form 18 has a final terminal 14. The winding form or bobbin 18 could be generally of the type disclosed in the earlier patent No. 3,131,371, but has been disclosed in detail in FIG. 2 as a bobbin for a relay requiring only a single coil of wire, as opposed to a transformer bobbin as disclosed in the earlier mentioned patent. Also, the winding form or bobbin 18 is shown in an improved form, that will be described in more detail in connection with FIG. 2.

The winding machine 10 causes the arm 11 to place the wire 12 properly in a wound fashion around the terminal 13. The winding machine 10 then rotates the arbor means 20 in a clockwise direction as disclosed in FIG. 1 at 15. A retractable pin and support means 16 is mounted on the arbor means 20 on a back surface in opposition to a front surface 21 upon which the winding form or bobbin 18 is mounted. The retractable pin and support means 16 includes a pin 22, which is shown in FIG. 1 in its unretracted position.

The operation of the winding machine 10 and the arbor means 20 will be very briefly described in connection with FIG. 1 before the detailed structure of the arbor means 20 is discussed in connection with FIGS. 2 through 5. After the winding machine 10 has caused the arm 11 to wind the wire 12 around the terminal 13, the arbor means 20 is caused to rotate in the clockwise direction as indicated at 15. The wire 12 falls across the pin 22 before being wound into the winding form 18. The laying of the wire 12 across the pin 22 causes a small loop to be developed in the wire and this loop is used as a strain relief for the finished electrical product.

As the arbor means 20 and the bobbin 18 comes up to a normal rotational speed, the mechanism 16 centrifugally is actuated to move the pin 22 back (into the paper) which withdraws the pin 22 from contact with the wire 12. This prevents any motion between the bobbin or winding form 18, and the wire 12 from breaking the wire at the point at which it crosses the pin 22. Past experience has shown that a fixed pin causes unnecessary breakage of the wire if the wire is of a small size.

Figure 2:
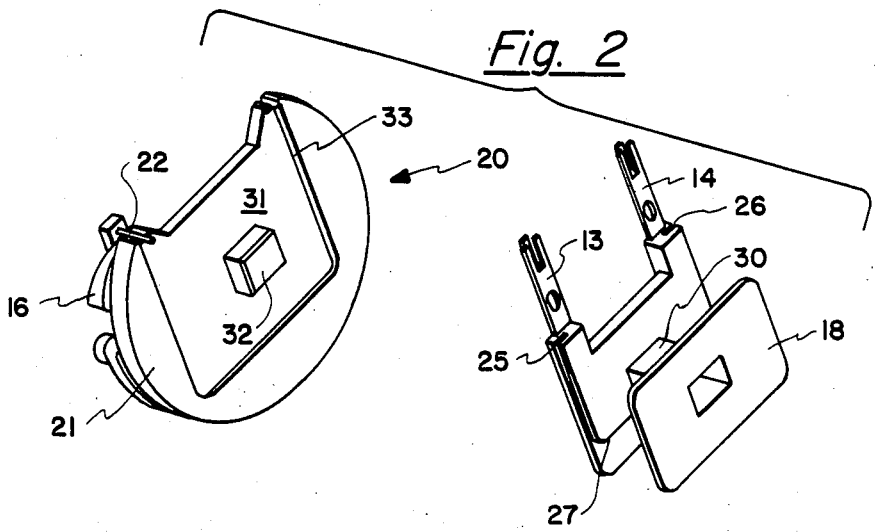
FIG. 2 is an exploded view of a winding arbor and a winding form.

In FIG. 2 an exploded view of the winding form 18 and of the arbor means 20 is disclosed. The winding form 18 has the terminals 13 and 14 with each of the terminals adjacent to slots or grooves 25 and 26 within the winding form 18. The slot 25 is a lead-in slot that opens at 27 to the center winding portion 30 of the winding form or bobbin 18. A wire wrapped around the terminal 13 and led to the slot 25 and is automatically fed to the opening 27 where it is started around the winding portion 30. When the winding is completed, the wire is led out of the slot 26 where it can be wound around the terminal 14. The winding operation described is conventional, and has been provided only as a means of explaining the location of the winding form or bobbin 18 on the arbor means 20.

The winding form or bobbin 18 is placed in a recess 31 that has an upstanding portion 32 along with a peripheral edge 33. The surface 31, the upstanding portion 32, and the edge 33 cause the winding form or bobbin 18 to be properly position in the arbor means 20 prior to winding. As indicated previously, means can be provided to manually place the winding form 18 or to automatically place it and hold it during the winding operation. Since that is not part of the present invention it has been left undisclosed to avoid confusion. As is seen in FIG. 2, when the winding form or bobbin means 18 is assembled against the arbor means 20 the terminal 13 would be adjacent to the pin 22, and this is brought out in connection with the assembled view in FIG. 3.

Figure 3:
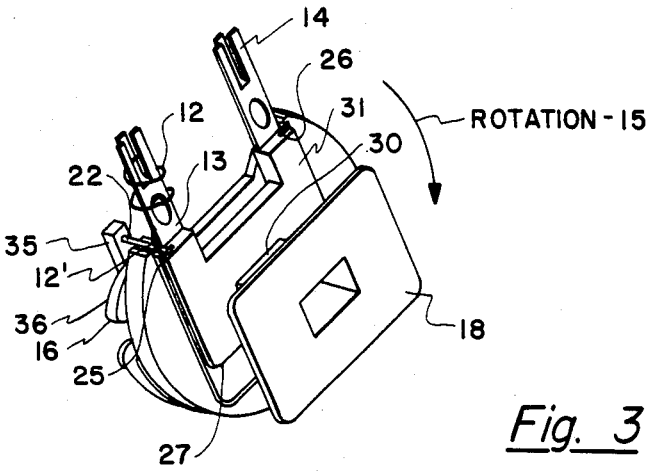
FIG. 3 is an assembled view of FIG. 2.

In FIG. 3 an assembled view is disclosed with the bobbin 18 placed in the recess 31 of the arbor means 20. The pin 22 is shown adjacent the terminal 13 with a wire 12 disclosed lying at 12' over the pin 22. The wire 12' then continues in the slot 25 to its exit point 27 where it can be wound on the center 30 of the winding form 18. Once again, the rotation has been indicated as a counter-clockwise rotation at 15. The assembly of FIG. 3 discloses the winding form or bobbin means 18 and the arbor means 20 just prior to the high speed rotation of that assembly to wind the wire 12 on the winding form or bobbin means 18. It will be understood that as soon as the high speed rotation of the arbor means 20 begins (around a center of rotation of the entire arbor structure) that the centrifugally actuated mechanism 16 causes the pin 22 to be withdrawn by a pin support 35 into which the pin is mounted. This removes the pin 22 from contact with the wire 12 thereby eliminating any possibility of any breakage at the point where the wire 12 crosses the pin 22, and which is the point at which the strain relief loop in the wire has been formed.

The high speed rotation of the arbor means 20 causes the centrifugally actuated means 16 to cause a ramp 36 to move against the support member 35 thereby driving the support member 35 in a backward direction (into the paper) removing the pin 22 from contact with the wire 12. It is understood that when the winding operation is approaching its end, the winding arbor means 20 ceases its rotational action and a spring (disclosed in FIGS. 4 and 5) drives the centrifugally actuated means 16 back to the position shown in FIG. 3 inserting the pin 22 in its original position ready for the next winding operation. The winding function is completed by the wire 12 being brought up in the slot 26 to the terminal 14 where the coil assembly is completed.

Figure 4:
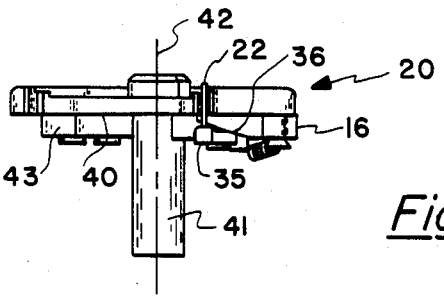
FIG. 4 is a top view of the novel winding arbor.

In FIG. 4 a top view of just the winding arbor means 20 is disclosed. The winding arbor means 20 has the recess 31 which forms part of the front surface on an opposite side from the backside 40 of the arbor means 20. The arbor means 20 has a centrally located shaft 41 and a center of rotation 42 which is used for the arbor means 20 and provides the winding action for the wire upon the winding form 18. Also placed on the second surface 40 is a counter weight 43 that matches the weight of the centrifugally actuated means 16 that is shown opposite it. The pin 22 is disclosed as supported by the member 35 which is against the ramp surface 36 of the centrifugally actuated means 16.

Figure 5:
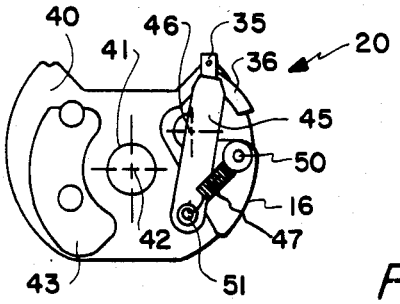
FIG. 5 is a backside view of the winding arbor of FIG. 4.

The balance of the description of the arbor can best be understood in connection with FIG. 5. The center of rotation 42 of the shaft 41 is disclosed as projecting from the backside 40 of the arbor means 20. The counter weight 43 is disclosed attached to the backside 40. Also attached to the backside 40 is the centrifugally actuated means 16 which includes the ramped surface 36 and the pin holder 35. A leaf spring 45 is disclosed as holding the member 35 against the ramp surface 36. As the arbor is rotated, the leaf spring 45 maintains a force on the member 35 to hold it against the ramp 36, which has moved the structure so that the pin 22 is out of the way.

The centrifugally actuated member 16 has a center of rotation 46 to provide the centrifugally actuated motion. The center of rotation 46 is displaced from the center of rotation 42 of the arbor means 20. A coil spring 47 is disclosed connected to a pin 50 that in turn is connected to the main structure of the centrifugally actuated member 16, and is anchored at 51 at the anchor point of the leaf spring 45. The coil spring 47 returns the centrifugally actuated means 16 to the position shown when no rotation occurs and is used as a bias to properly balance and actuate the centrifugally actuated means 16.

From the above description it can be seen that an arbor for winding machines is improved by the addition of a centrifugally actuated member that withdraws a pin from alongside of a first terminal after a wire has passed over the pin to form a strain relief loop. By removing the pin during the winding action, fine wires have been found to remain in tact during the winding operation. The present invention has substantially eliminated breakage due to any stress between the wire 12 and the pin 22. A very simple centrifugally actuated mechanism for removing the pin during the winding application has been disclosed. This structure could be altered in many ways to accomplish the same end result. As such, the applicant wishes to be limited by the scope of this invention solely by the scope of the appended claims.

The embodiments of the invention in which an exclusive property or right is claimed are defined as follows:

1. An arbor means for use with an automatic coil winding machine, including: arbor means adapted to receive and hold on a front arbor surface an insulated winding form upon which a coil of insulated wire is to be wound; said winding form having at least one electric terminal upon which said wire is initially secured by said winding machine; retractable pin and support means mounted upon said arbor means and including a retractable pin positioned adjacent a side of said terminal; said pin and support means including centrifugally actuated means mounted on said arbor means; said retractable pin and support means further including bias means to hold said retractable pin adjacent said side of said terminal with said pin acting to form a strain relief in a portion of said wire when the winding of said coil is initiated; means for rotating said arbor means with said winding form and means mounting said centrifugally actuated means for withdrawing said pin from said side of said terminal and out of contact with said strain relief portion of said wire to avoid subsequent breakage of said wire.

2. An arbor means as claimed in claim 1 with means for mounting said retractable pin and support means on a backside of said arbor means.

3. An arbor means as claimed in claim 2 wherein said centrifugally actuated means includes a weighted member with means for mounting said weighted member displaced from an axis of rotation of said arbor means.

4. An arbor means as claimed in claim 3 wherein said arbor means has a counter weight mounted on said backside of said arbor means to balance said arbor means.

5. An arbor means as claimed in claim 4 wherein said centrifugally actuated means includes a sloped ramp; and means for mounting said pin in a member held against said ramp by a first spring member; said sloped ramp acting to move said pin upon said centrifugally actuated means rotating about its axis.

6. An arbor means as claimed in claim 5 wherein said centrifugally actuated means is biased by a second spring member; said two spring members returning said pin to a position adjacent said side of said terminal when said arbor means is stationary.

* * * * *